United States Patent [19]

Adlerteg et al.

[11] 4,408,173

[45] Oct. 4, 1983

[54] ELECTRIC SWITCH

[75] Inventors: Bo Adlerteg; Lennart Grees, both of Västerås, Sweden

[73] Assignee: ASEA Aktiebolag, Västeras, Sweden

[21] Appl. No.: 315,901

[22] Filed: Oct. 28, 1981

[30] Foreign Application Priority Data

Oct. 30, 1980 [SE] Sweden ..... 8007633

[51] Int. Cl.[3] ..... H01H 73/00; H01H 77/00

[52] U.S. Cl. ..... 335/16; 335/6

[58] Field of Search ..... 335/16, 195, 6

[56] References Cited

U.S. PATENT DOCUMENTS 4,258,343 3/1981 Kussy ..... 335/16

*Primary Examiner*—Harold Broome

*Attorney, Agent, or Firm*—Watson, Cole, Grindle & Watson

[57] ABSTRACT

An electromagnetically operated electric switch combines the function of a contactor and a current-limiting circuit-breaker. The contact assembly of the switch includes two contact systems, which are different in function, with a fixed contact which is common to both systems. The first contact system is intended for normal operating current connections, whereas the other contact system is intended for breaking short-circuit currents. The contact-making elements in the two contact systems can be made of different contact materials, in order to obtain a long electrical and mechanical life.

9 Claims, 3 Drawing Figures

ELECTRIC SWITCH

BACKGROUND OF THE INVENTION

This invention relates to an electromagnetically operable electric switch of the kind having at least one breaking unit comprising two electrically series-connected contacts.

In low voltage switching equipment it is customary to employ a plurality of series-connected devices in one and the same current supply circuit. For example, the supply circuit for an electric motor may include a load switch, fuses, a contactor, an overload relay and a safety switch. Such a circuit has the disadvantage that it is difficult to coordinate the various switching devices with the short-circuit protection members in a functional manner. Other disadvantages are that the devices occupy a relatively large space when mounted in a switchgear cubicle, that they have a large number of connection points and that they have relatively high power losses.

1. Field of the Invention

To overcome the above-mentioned disadvantages, attempts have been made to combine different functions in one and the same device, for example by constructing a contactor so that it also operates as a current-limiting circuit-breaker (see e.g. German Auslegeschrift No. 1 194 956 and Swedish Published Patent Application No. 7714933-4). However, with the contact means that have been proposed for such devices, it is difficult to achieve simultaneously a high breaking capacity and a long service life.

2. Description of the Prior Art

The present invention aims to provide an electric switch which combines the functions of a contactor and a circuit-breaker and which has a long electrical and mechanical life and is capable of dealing with short-circuit interruptions.

According to the invention, in an electromagnetically operable electric switch having at least one breaking unit comprising first and second electrically series-connected openable contact systems, the first contact system comprises a movable first contact, and electromagnetic means controlling engagement of the first contact with a fixed second contact, and the second contact system comprises a movable third contact normally engaged with the fixed second contact and disengageable from the fixed second contact only in response to a current through the switch considerably in excess of the rated current of the switch, the fixed second contact being disposed intermediate the first and third contacts.

In a preferred embodiment of the switch in accordance with the invention, the contacts of the first contact system are made of a first material having properties suitable for making and breaking currents occurring during normal operation of the switch, and the contacts of the second contact system are made of a second material having properties suitable for interrupting short-circuit currents.

BRIEF DESCRIPTION OF DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENT

Figure 1:
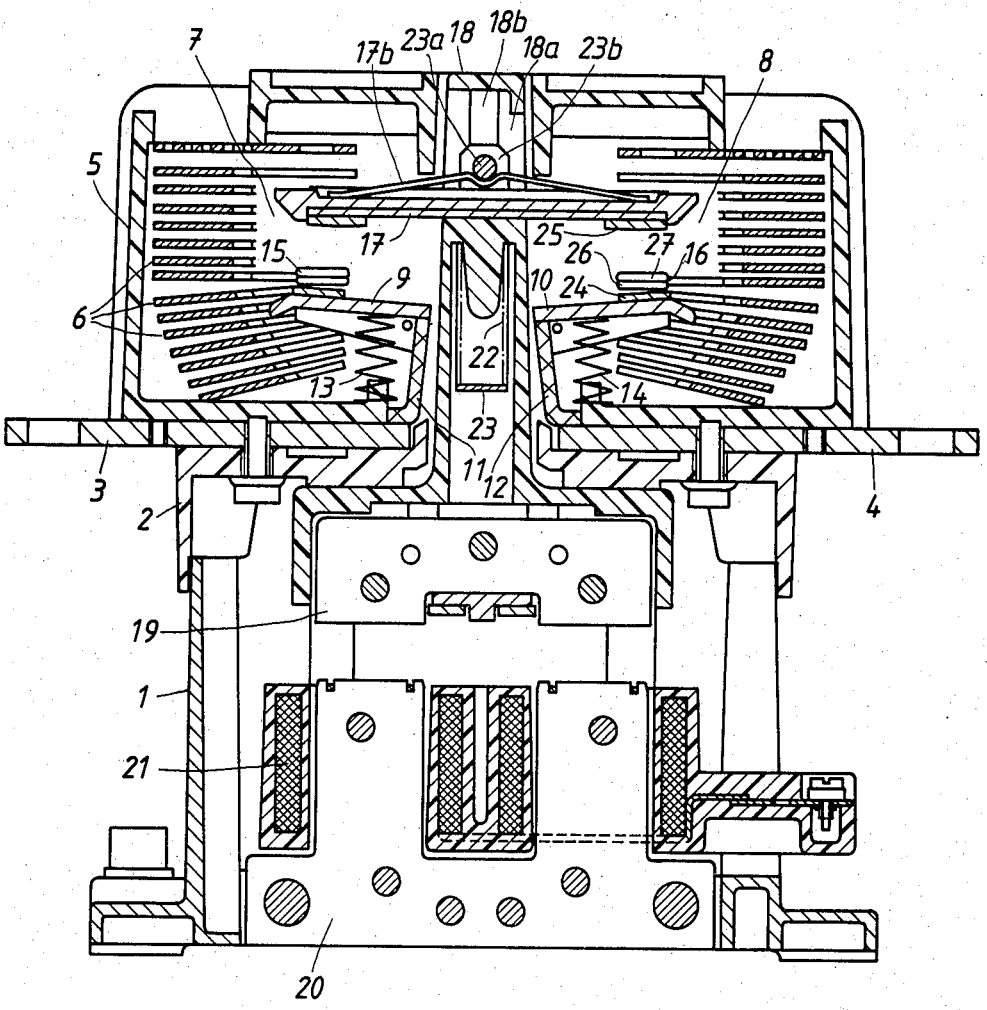
FIG. 1 is a sectional side view of one embodiment of an electric switch according to the invention, shown in open contact position.

The electric switch shown in the drawing is intended for ratings of up to about 1000 A and 1000 V. The switch is of three-pole design, but for the sake of simplicity only one pole is shown in the drawing. The switch is mounted on a stand 1 of pressure-cast light metal. The stand 1 supports a holder 2 of plastics material with connection bars 3, 4 for connecting the switch into an external main circuit.

The contact means of the switch is surrounded by an arc chute 5 of plastics material provided with arc extinction plates 6. The contact means includes two electrically series-connected breaking units, which are arranged in respective breaking chambers 7, 8 formed in the arc chute. Each breaking unit has a rotatably journalled breaking contact 9 and 10, respectively, which via a flexible conductor 11 and 12, respectively, is connected to the connection bar 3 and 4, respectively. By springs 13 and 14, the breaking contacts 9 and 10, respectively, are biased against fixedly arranged intermediate contacts 15 and 16, respectively. These intermediate contacts are connected to each other, in closed contact position, through a movable bridge contact 17. The bridge contact 17 passes through a slot **18*a* in a contact carrier 18 which is connected to the armature 19 of an operating electromagnet of the switch, the magnetic core and coil of this electromagnet being designated 20 and 21, respectively. When the coil 21 is de-energised, the armature 19 is biased to the position shown in FIG. 1, relative to the core 20, by springs (not shown). Within the contact carrier 18 the bridge contact 17 passes between the limbs 23*b* of a U-shaped yoke 23 which is vertically slidable in the carrier 18. The free, upper ends of the yoke limbs 23*b* are connected together by a pin 23*a* which has its ends slidable in vertical slots 18*b* in the carrier 18. Between the pin 23*a* and the bridge contact 17 there is a leaf spring 17*b*. With the coil 21 de-energised, the armature 19, the carrier 18 and the bridge contact 17 are in the positions shown in FIG. 1. In this condition of the switch, the yoke 23 and the pin 23*a* are urged downwardly by a compression spring 22 to hold the bridge contact 17 against the lower edge of the slot 18*a* in the carrier 18. When the coil 21 is energised, the contact carrier 18 moves downwardly to the position shown in FIG. 2 and the bridge contact 17 makes contact with the fixed contacts 15, 16. In this closed contact position of the bridge contact 17, the latter is no longer urged against the lower edge of the slot 18*a*, but is free to rock slightly in the yoke 23 to ensure that it makes good electrical contact with both of the fixed contacts 15 and 16**.

The contact means of the electric switch shown thus consists of two functionally different contact systems, namely a contactor system including the bridge contact 17 and a circuit-breaker system including the rotatably journalled breaking contacts 9, 10. The fixed intermediate contacts 15, 16 are common to both of these contact systems.

The movable contacts 9, 10 and 17 may be made, for example, of copper and/or aluminum and provided with contact buttons 24, 25 of a silver alloy for carrying out the electric contact function. Each of the fixed intermediate contacts 15, 16 consists, in the embodiment shown, of two such contact buttons 26 and 27 which are joined together. Alternatively these intermediate contacts may be constructed instead with a supporting part of, for example, copper, which is suitably designed to serve simultaneously as an arc horn.

The contact buttons 25, 27 in the contactor system are made, for example, of silver cadmium oxide or other contact material which has a long life when connecting currents which occur during normal operation. The contact buttons 24, 26 in the circuit-breaker system, on the other hand, are made of a contact material with especially suitable properties for breaking short-circuit currents, for example silver-tungsten, silver-graphite or silver-nickel.

Under normal operating conditions, the above described switch is employed as a conventional contactor by moving the bridge contact 17 into open contact position or closed contact position by de-energising or energising the coil 21. During such normal operating conditions, the movable contacts 9, 10 in the circuit-breaker system are constantly biased by the springs 13, 14 into contact with the fixed intermediate contacts 15, 16, respectively. The springs 13, 14 are dimensioned so that the contacts 9, 10 do not open when the switch is traversed by normal starting currents for motors (about ten times the rated current).

Figure 2:
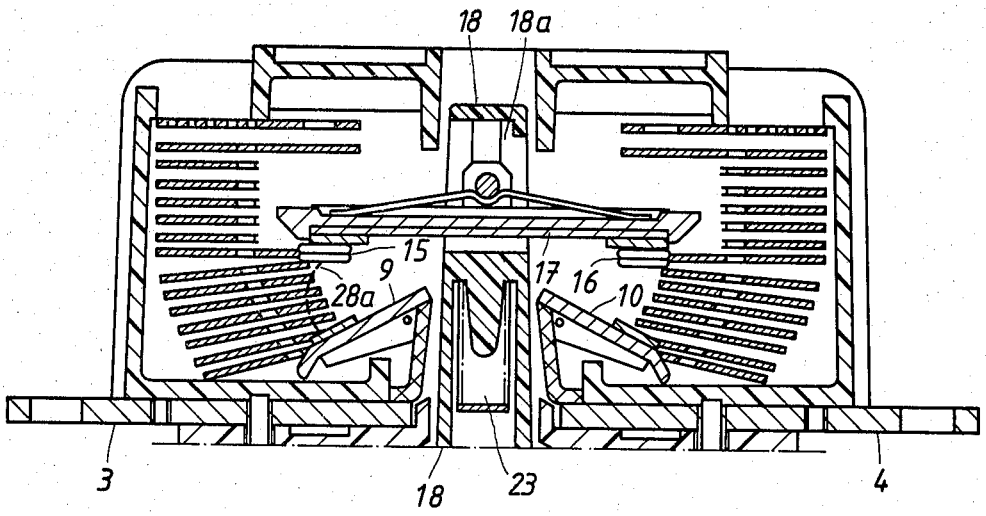
FIG. 2 is a sectional side view of the breaking chamber of the switch of FIG. 1 during the first part of a short-circuit interruption.
Figure 3:
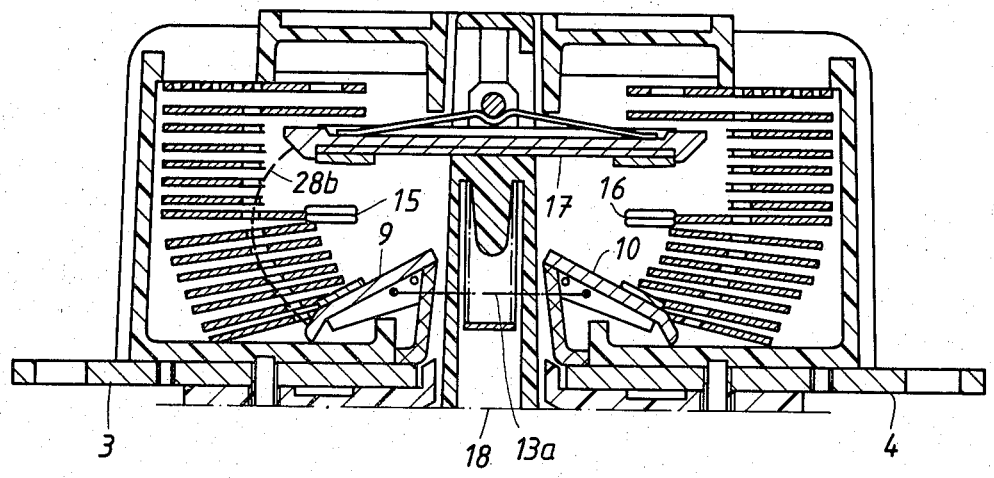
FIG. 3 is a view similar to FIG. 2 but showing the parts in the positions they adopt during the latter part of the short-circuit interruption.

If, with the bridge contact 17 in its closed contact position, a short-circuit occurs in the external circuit into which the switch is connected so that the current through the switch exceeds a certain value, the movable breaking contacts 9, 10 will be rapidly thrown out of their closed contact position, by the action of electrodynamic forces, to the intermediate position shown in FIG. 2. Two series-connected breaking arcs then form between the breaking contacts 9, 10 and the intermediate contacts 15, 16, respectively, along paths such as indicated by the broken line 28*a* in FIG. 2. The contacts 9, 10, which may possibly be made of aluminum, have a relatively small mass, so the contact opening takes place very rapidly. The current will therefore be limited to a lower value than the peak value of the prospective short-circuit current. The current forces also influence the bridge contact 17 in the opening direction, so that soon after the breaking contacts 9, 10 have opened, the bridge contact 17 commences to open under the influence of the current forces. At this time, the current to the operating coil 21 has already been broken by trigger devices (not shown) which are influenced by the current in the main circuit, so that armature 19 and the carrier 18 return to the positions shown in FIG. 1. When the bridge contact 17 separates from the fixed contacts 15, 16, the two series-connected breaking arcs will follow paths, such as that indicated by the broken line 28*b* in FIG. 3, between the tips of the contacts 9, 10 and the bridge contact 17. Under the influence of electromagnetic forces, the arcs will then be rapidly moved outwards between the extinction plates 6 in the breaking chambers 7, 8, where they are deionized and extinguished. The movable contacts 9, 10 in the circuit-breaker system will then be restored by the springs 13, 14 to closed contact position.

The invention is not limited to the embodiment shown but may be implemented in several different ways. For example, instead of the compression springs 13, 14, at least one tension spring may be used with its two ends attached to the breaking contacts 9, 10, respectively. The, or each, tension spring is arranged so that, when the contacts 9, 10 during an opening movement pass an intermediate position, the spring changes from influencing these contacts in a contact-closing direction to influencing them in a contact-opening direction. Restoration of the breaking contacts to closed contact position may be effected by the magnet armature 19 by pins or the like arranged on the contact carrier 18. The connection of such a tension spring to the contacts 9, 10 is indicated by the chain line 13*a* in FIG. 3.

Obviously, numerous modifications and variations of the present invention are possible in light of the above teachings. It is therefore to be understood that within the scope of the appended claims, the invention may be practiced otherwise than as specificially described herein.

What is claimed is:

1. An electromagnetically operable electric switch having a predetermined current rating comprising:

at least one breaking unit comprising:

a first openable contact system; and a second openable contact system electrically series connected to said first openable contact system;

said first openable contact system comprising:

a movable first contact;

a fixed second contact; and electromagnetic means controlling engagement of said first contact with said second contact;

said second openable contact system comprising:

a movable third contact normally engaged with said fixed second contact and disengageable from said fixed second contact exclusively in response to electrodynamic forces created by the passage of a current through said switch greater than ten times said predetermined current rating and comprising a second material having properties suitable for interrupting short circuit currents;

said fixed second contact being disposed intermediate said first and third contacts and comprising:

a first contact element forming a part of said first contact system and comprising a first material suitable for making and breaking currents occurring during normal operation of said switch; and a second contact element forming a part of said second contact system and electrically connected to said first contact element and comprising said second material different from said first material.

2. An electric switch according to claim 1, wherein said electromagnetic means comprises an armature, means mechanically connecting said armature to said first contact, and, an electromagnet for moving said armature between a first position in which said first and second contacts engage one another and a second position in which said first and second contacts are disengaged from one another.

3. An electric switch according to claim 1, wherein said first material is silver cadmium oxide and said second material is silver alloyed with tungsten.

4. An electric switch according to claim 1, wherein said first, second and third contacts form a loop-formed current path, whereby said third contact during passage of current therethrough, is influenced by an electrodynamic force in a direction tending to separate it from engagement with said fixed second contact.

5. An electric switch according to claim 1, wherein said third contact is biased by spring means into engagement with said fixed second contact.

6. An electric switch according to claim 1, and comprising two of said breaking units electrically series-connected with one another, wherein said first contacts of said two breaking units are combined to form a bridge contact.

7. An electric switch according to claim 1, and comprising two of said breaking units electrically series-connected with one another, wherein said third contacts of said two breaking units are mechanically interconnected by at least one tension spring means, which is arranged in such a way that, when said third contacts during an opening movement pass an intermediate position, said tension spring means changes from influencing said third contacts in a contact-closing direction to influencing them in a contact-opening direction.

8. An electric switch according to claim 1, wherein said first material is silver cadmium oxide and said second material is silver alloyed with graphite.

9. An electric switch according to claim 1, wherein said first material is silver cadmium oxide and said second material is silver alloyed with nickel.

* * * * *